US007985169B2

(12) United States Patent
Tudico

(10) Patent No.: US 7,985,169 B2
(45) Date of Patent: Jul. 26, 2011

(54) APPARATUS FOR GLOBAL CORPORAL MOBILIZATION AND USE THEREOF

(75) Inventor: Gianfranco Tudico, Bourg-les-Valence (FR)

(73) Assignee: Genda Limited-Chez John Behan & Company, Dublin (IE)

( * ) Notice: Subject to any disclaimer, the term of this patent is extended or adjusted under 35 U.S.C. 154(b) by 150 days.

(21) Appl. No.: 12/303,945

(22) PCT Filed: Jun. 8, 2007

(86) PCT No.: PCT/FR2007/000947

§ 371 (c)(1),
(2), (4) Date: Feb. 18, 2009

(87) PCT Pub. No.: WO2007/141429

PCT Pub. Date: Dec. 13, 2007

(65) Prior Publication Data

US 2010/0222187 A1 Sep. 2, 2010

(30) Foreign Application Priority Data

Jun. 9, 2006 (FR) ..... 06 05137

(51) Int. Cl.
*A63B 26/00* (2006.01)

(52) U.S. Cl. ..... 482/147

(58) Field of Classification Search ..... 482/1, 4, 482/7, 23, 34, 51, 71, 79–80, 110, 133–136, 482/142, 146–147; 434/247, 255, 258; 601/23–24, 601/26–27, 32; 472/1, 29, 95–97; *A63B 26/00*
See application file for complete search history.

(56) References Cited

U.S. PATENT DOCUMENTS 2,827,894 A * 3/1958 Meyers ..... 601/31
(Continued)

FOREIGN PATENT DOCUMENTS

DE 40 03 186 8/1991
(Continued)

OTHER PUBLICATIONS

International Search Report Received in PCT Application No. PCT/FR2007/001029; Dec. 4, 2007.

(Continued)

*Primary Examiner* — Loan Thanh
*Assistant Examiner* — Oren Ginsberg
(74) *Attorney, Agent, or Firm* — Advantedge Law Group

(57) ABSTRACT

The invention concerns an apparatus (1) comprising a chassis (10) supported on the ground (S), a mobile platform (44) supporting a subject, and motorized means (30, 32, 38) for driving the platform relative to the chassis. In order to put the subject off balance while moving its lifting polygon, so as to act on the subject'body according to advanced kinematics, the driving means are capable of moving the platform off-center relative to a substantially vertical fixed axis (Z-Z) and of driving the platform in rotation about said axis when the platform is off-center, whereas the platform is provided with peripheral mobile supporting means (60, 62) on corresponding bearing means (64) secured to the chassis (10), said supporting means being capable of resting the platform on the chassis by adjustably inclining same relative to the horizontal in a plane passing through the fixed axis and a central region of the platform when the driving means move the platform off-center relative to said axis. The apparatus thus generates remarkable neuro-biomechanical actions, while having a reliable lightweight and compact structure.

15 Claims, 10 Drawing Sheets

U.S. PATENT DOCUMENTS

| | | | | |
|---|---|---|---|---|
| 3,912,260 | A * | 10/1975 | Rice | 482/4 |
| 4,519,787 | A * | 5/1985 | Williams | 446/313 |
| 5,165,389 | A * | 11/1992 | Jing-Qi et al. | 601/24 |
| 5,599,262 | A | 2/1997 | Shih | |
| 5,665,053 | A | 9/1997 | Jacobs | |
| 5,813,958 | A * | 9/1998 | Tomita | 482/146 |
| 6,402,626 | B1 * | 6/2002 | Beaty | 472/96 |
| 6,428,451 | B1 | 8/2002 | Hall | |
| 6,558,304 | B1 * | 5/2003 | Bardon et al. | 482/147 |
| 7,175,577 | B2 * | 2/2007 | Greenspan et al. | 482/146 |
| 7,282,013 | B2 * | 10/2007 | Ho | 482/51 |
| 7,374,522 | B2 * | 5/2008 | Arnold | 482/146 |
| 2009/0209886 | A1 | 8/2009 | Tudico | |

FOREIGN PATENT DOCUMENTS

| | | |
|---|---|---|
| WO | WO 2004/039458 | 5/2004 |

OTHER PUBLICATIONS

International Search Report received in PCT/FR2007/000947; Oct. 31, 2007.

* cited by examiner

APPARATUS FOR GLOBAL CORPORAL MOBILIZATION AND USE THEREOF

The present invention relates to an apparatus for the overall bodily mobilization of a human subject, that is to say an apparatus making it possible to set in motion the trunk, the limbs and the joints of the subject, and a use of such an apparatus.

This type of apparatus is designed, preferably but not exclusively, to be used under the supervision of a physiotherapist who determines the mobilization movements generated by the apparatus.

Recent neurophysiology studies reveal that the effectiveness of physiotherapy or osteotherapy care, applied for example to an injured subject, an aging person or a healthy subject, or else to a high-level sports person, is associated with the stimulation of the neurobiomechanical capabilities of the subject. Specifically, to stay upright and control the body, human beings receive information via various sensors, notably articular, vestibular, visual, cutaneous, etc. sensors. The brain processes this information by comparing it with internal models, that are innate and acquired, according to which human beings adjust their bodily responses. However, these internal models are sometimes insufficiently adaptive to respond to new situations, some of these models being able to have been lost or never having been acquired by training. It is understood that the richness of these models depends on the capability of the subject to adapt to the difficulties of the environment in which he moves and/or acts. In addition, in order for the instructions to control the movements of the body of the subject given by his brain to be effective, the articulations of the subject must be functionally reactive and the muscles which underpin these articulations must be strong and flexible. However, a portion of the motor competences of the subject may be lost, notably following an accident, as he ages, when he adopts inappropriate working postures or when he suffers from excess nervous tension.

It is therefore understandable that the recovery or the training of the neurobiomechanical competences of the subject require stimulations and combined simulations as complete and varied as possible of his musculo-articular functions and of his neuro-vigilance capabilities.

Items of apparatus that allow such a recovery or such a training are practically nonexistent today. The few items of apparatus available usually consist of a motorized platform which both rests and oscillates on a central bearing pivot, as in U.S. Pat. No. 2,827,894 and U.S. Pat. No. 4,313,603. The movements of these platforms provoke an imbalance of the body of the subject standing on the platform and induce thereby bodily reactions on his part. However, in practise, since all the mobilization movements generated by these items of apparatus are centered on their central bearing pivot, the body of the subject is not or is only slightly thrown off balance: during the movements of the apparatus, the basis of support of the subject's body, that is to say the virtual surface lying between the bearing points of the subject's feet standing upright on the platform and inside which the center of gravity of the subject's body should be projected so that the latter is not thrown totally off balance and falls, remains centered on the central bearing pivot. In other words, the sagittal axis of the subject's body remains generally in line with the central bearing pivot, which allows only a moderate bodily reaction, and always of the same type. In addition, the subject's weight and the forces that he generates so as not to fall are sustained in totality by the central bearing pivot, which makes it necessary, in order to limit the risks of breakage, to manufacture the latter in a particularly strong form, notably in the form of a cardan joint. The motive force necessary to operate the platform must then be designed appropriately, which results, in a particularly heavy and bulky apparatus.

U.S. Pat. No. 5,813,958 also proposes an apparatus with an oscillating motorized platform which, in certain embodiments, incorporates a platform to support the subject, having a pre-set tilt so that the center of this platform is offcenter by a fixed distance relative to the vertical axis about which the platform rotates. In service, the imbalance of the subject is greater than with the items of apparatus mentioned above, but, because the tilt of the platform is fixed, linked to the very structure of the apparatus, the mobilization movements generated have kinematics that are fixed and therefore not very effective and not very powerful to the extent that the subject rapidly takes account of the fixed offcentering of the platform in order to quickly regain his balance and neutralize the neurobiomechanical stimulation supplied by the apparatus by anticipating the characteristics of this stimulation. In addition, the structure of the apparatus is particularly heavy and bulky because of the interposition between the frame of the apparatus and its platform of a rotary disk on which the platform rests in order to be tilted in a preset manner.

The object of the present invention is to propose an apparatus for overall bodily mobilization which, while being reliable, light and having a small space requirement, makes it possible both to throw the subject off balance and significantly move the basis of support and the instantaneous pressure centers of the subject's body in an effective and controlled manner, in order to act on the body in movements generated so as to strengthen or maintain the subject's neurobiomechanical competences.

Accordingly, the subject of the invention is an apparatus for overall bodily mobilization of a human subject, as defined in claim 1.

Thanks to the apparatus according to the invention, the center of the basis of support and the instantaneous pressure centers of a subject's body may be moved aside transversely from the fixed axis defined by the apparatus: when the subject stands, notably upright, on the platform, his basis of support is generally centered on the central zone of the platform, while the latter is designed to be able to be thrown offcenter relative to the fixed axis. This throwing offcenter of the platform is accompanied by a tilting of the latter, controlled by the peripheral bearing means with which the platform is furnished, which causes the imbalance of the subject and the activation of his neurobiomechanical capabilities as explained above. In service, when the platform is operated in an offcenter manner about the fixed axis, the subject's body is mobilized by a centrifugal force in a circumferential direction coupled with a linear mobilization parallel to the plane of the platform, linked to the tilting of the latter. In other words, the apparatus according to the invention produces controlled movements of its platform which throw the subject off balance, causing a circumferential and laterally translational movement of the basis of support and of the instantaneous pressure centers of the subject's body.

The centrifugal effect of this movement is applied in particular to all the bodily elements that comprise the cylindrical beam formed by the trunk/abdomen assembly. The reaction to this centrifugal force is a powerful effort of centripetal restoration by all the muscles of the body.

The apparatus according to the invention therefore produces a neurobiomechanical action suited to the articular, muscular and informational complexity of the subject's body in order to return to him, as much as possible, all his dynamic potential or in order to push him to his neuromotive limits of adjustment. In practise, the apparatus generates various types of actions, such as vestibular, articular, cutaneous, postural, muscular, neurological, genitopelvic, etc. actions. Specifically, depending on the adjustments of the motorized means and depending on the posture of the subject on the platform, various zones of the body, and even the whole body, are mobilized in a coordinated manner. When the subject stands for example upright on the platform, it is possible to mobilize his legs only, his legs and his trunk, or his legs, his trunk and his arms. Depending on the muscular recruitment commanded, the bodily mobilization is accompanied by significant burning of calories. In a more general manner, on the apparatus, the subject's body must not be considered to be a rigid and stable object: on the contrary, this body is deformable and comprises a large number of articulations that are as many degrees of liberty to be mastered in order to maintain postural control and to obtain a variable and complex spatial orientation. The posturo-kinetic activities performed by the subject on the apparatus will ensure the coordination of the various articulated elements of his body: in response to the movements of the platform, the subject puts in place a postural strategy, that is to say an action plan that is coordinated between the various portions of his body involved in the activity, for the purpose of maintaining or recovering an efficient postural attitude.

In addition, in service, the weight of the subject and the mobilization efforts that he generates are sustained by the peripheral bearing means, in other words on the periphery of the platform, in a relatively extensive zone where, for example, several bearing point's may advantageously be provided, while the corresponding supporting means are supported fixedly by the frame, without having to interpose an additional movable component between the platform and the frame. The reliability and robustness of the apparatus are therefore remarkable. In addition, since the periphery of the platform supports, the highest forces, the operating means are advantageously provided to produce and transmit essentially, or even exclusively, the motive forces of movement of the platform. The motive force necessary has not had to be overengineered which results in a small space requirement of the platform operating means.

Other features of this apparatus, taken in isolation or in all the technically possible combinations, are set out in claims 2 to 15.

A further subject of the invention is the use of a mobilization apparatus as defined above, characterized in that both the amplitude of throwing offcenter of the platform relative to the fixed axis and the speed of rotary operation of the platform about this fixed axis are adjusted in a combined or separate manner.

This use is based on the presence of control means, belonging to the apparatus, suitable for adjusting the apparatus in an appropriate manner.

The invention will be better understood on reading the following description given only as an example and made with reference to the drawings in which.

Figure 2:
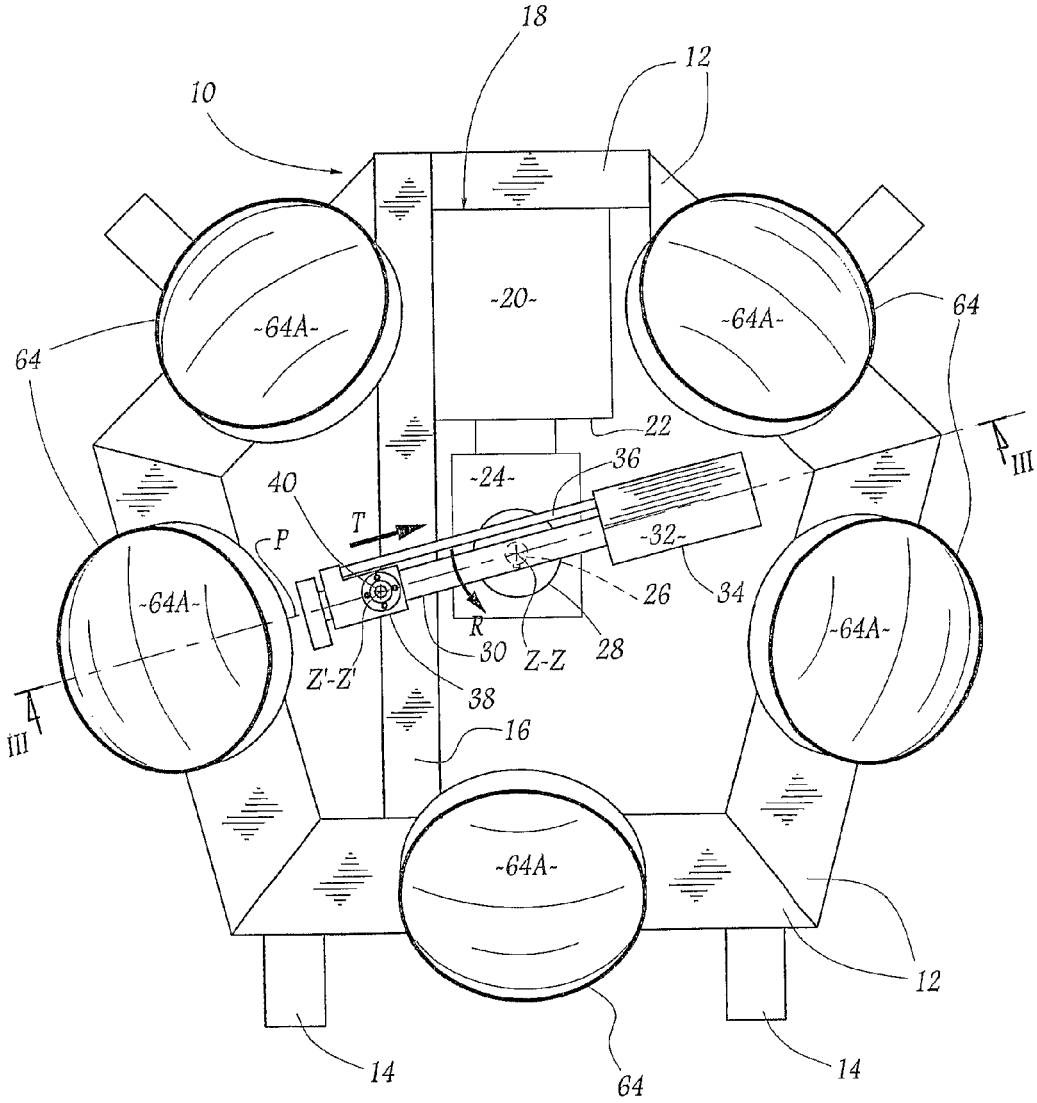
FIG. 2 is a schematic top view of the bottom portion of the apparatus in the direction of the arrow II of FIG. 1, in the absence of the platform of this apparatus.
Figure 8:
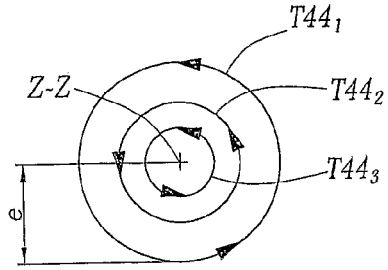
FIGS. 8 and 9 are diagrams illustrating trajectories of the center of the platform seen in the same direction of observation as in FIG. 2, for various operating configurations of the apparatus.
Figure 9:
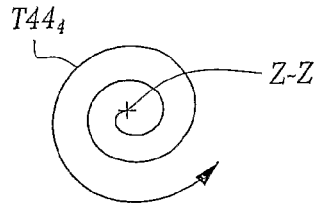
Figure 12:
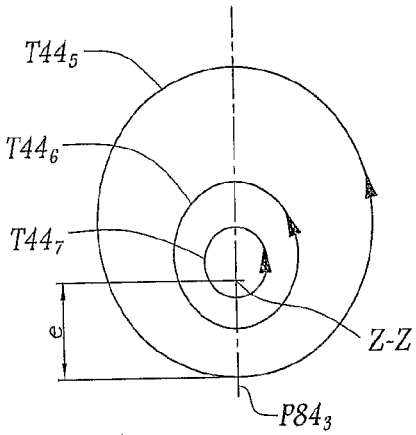
Figure 13:
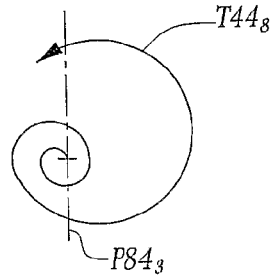
Figure 14:
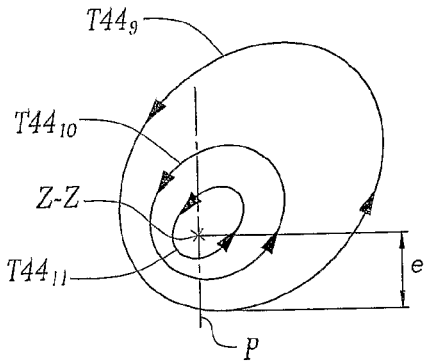
Figure 15:
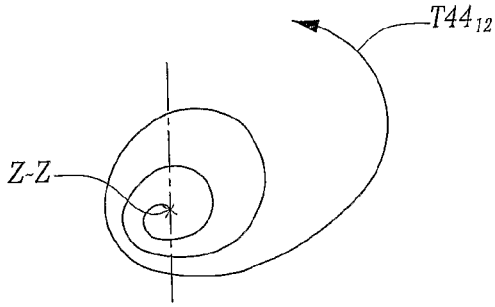
Figure 10:
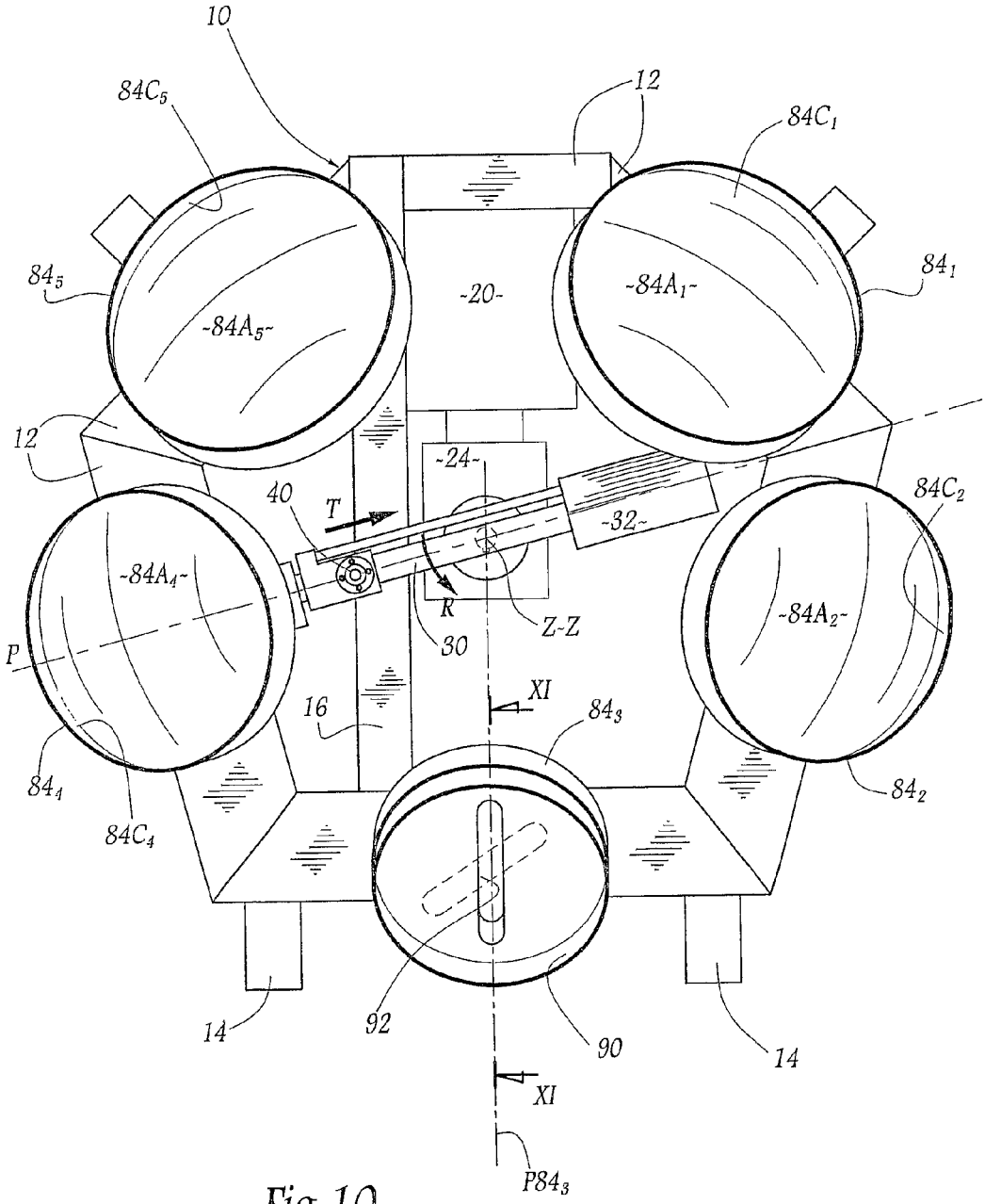
FIG. 10 is a view similar to FIG. 2, illustrating a variant embodiment of the apparatus according to the invention.
Figure 11:
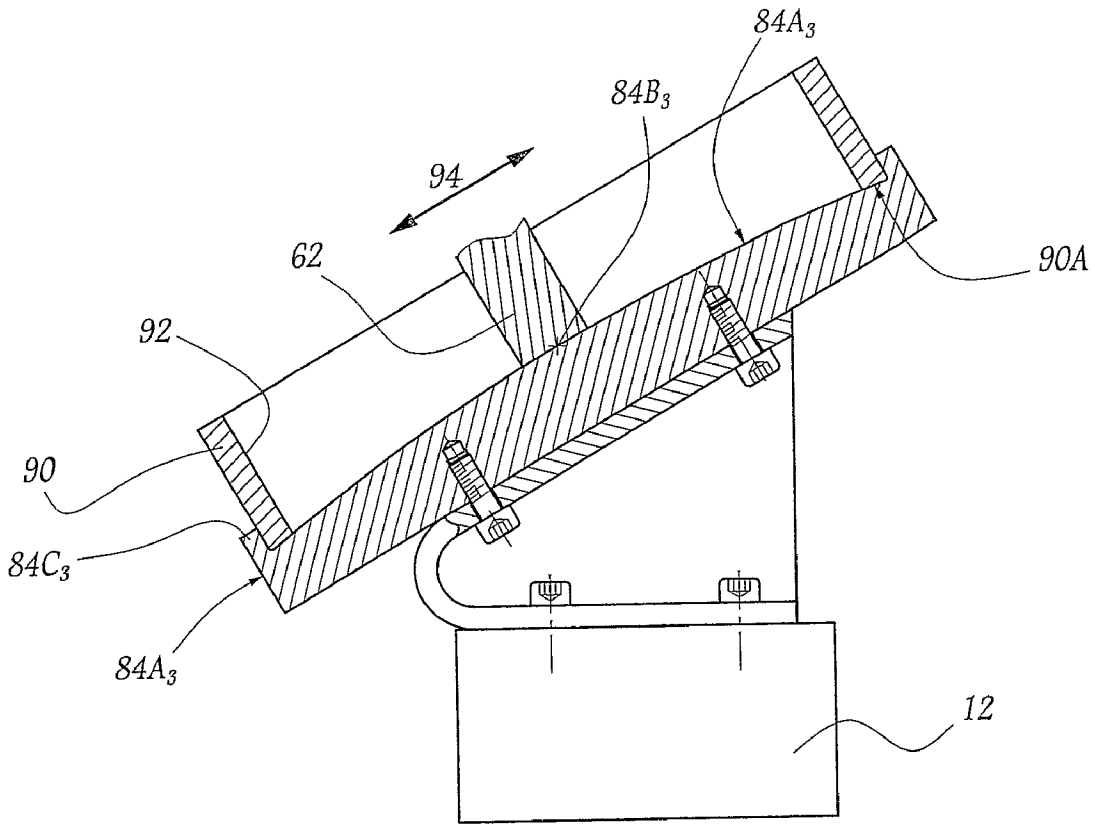
FIG. 11 is a partial section along the line XI-XI of FIG. 10.
Figure 16:
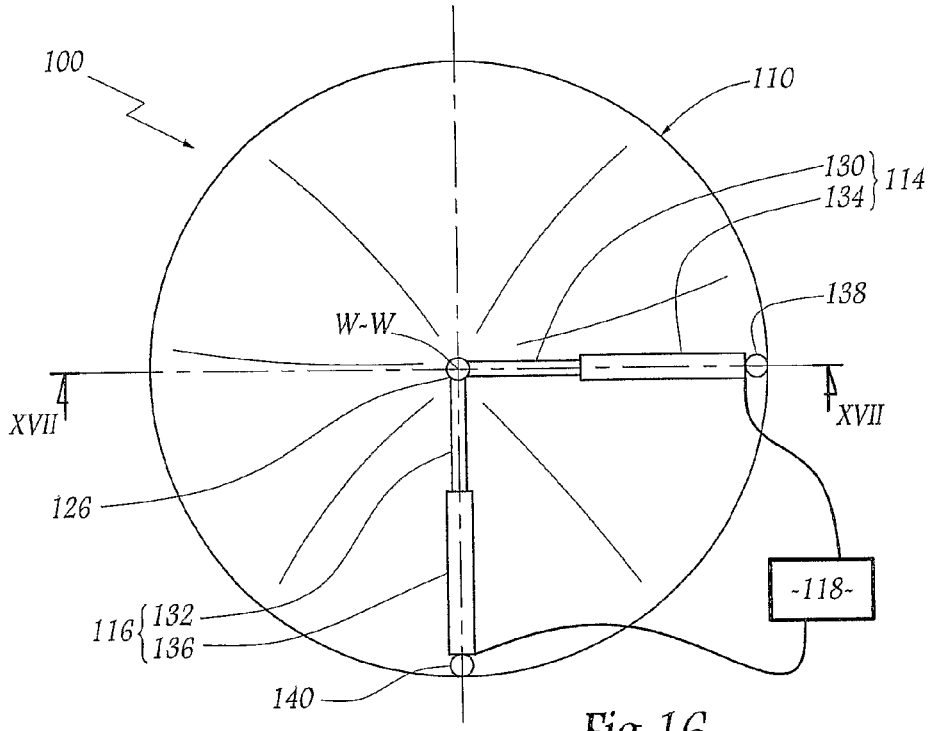
Figure 17:
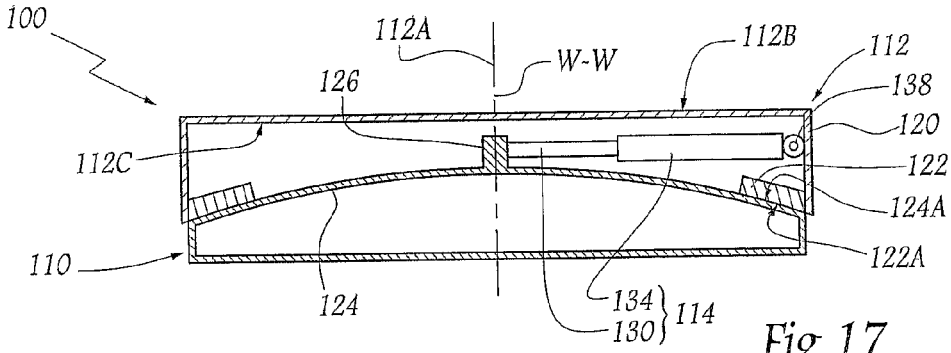
Figure 18:
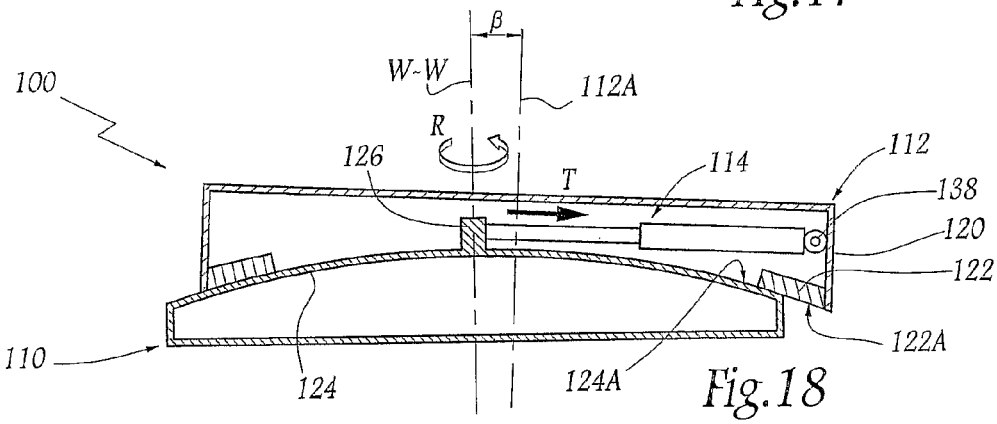

FIGS. 12 and 13 are views respectively similar to FIGS. 8 and 9 for the apparatus of FIGS. 10 and 11;

FIGS. 14 and 15 are views respectively similar to FIGS. 12 and 13 for a different adjustment of the apparatus;

FIGS. 16 to 18 are diagrams illustrating another embodiment of an apparatus according to the invention, FIG. 16 corresponding to a top view similar to that of FIG. 2, while FIG. 17 corresponds to a section along the line XVII-XVII of FIG. 16 and FIG. 18, similar to FIG. 17, illustrates the apparatus in a different operating configuration than that of FIG. 17.

FIGS. 1 to 7 represent an apparatus 1 for the bodily mobilization of a subject 2, designed to set in motion the limbs and articulations of the subject. The apparatus 1 is designed to be used under the supervision of a physiotherapist or a similar health professional, so that the latter determines the mobilization movements imposed on the subject by the apparatus. In practise, the apparatus 1 is used in a physiotherapist's or osteotherapist's medical office, or more generally in a care center, for example in a retirement home, or a thalassotherapy institute. As a variant, the subject may use the apparatus 1 in an autonomous manner, notably for the purpose of physical exercises, the apparatus then being made available in a gym or similar room.

The apparatus 1 comprises a frame 10 for resting on the ground S. For convenience, the rest of the description is oriented relative to the ground, so that the term "vertical" indicates a direction that is substantially perpendicular to the ground S, while the term "horizontal" indicates a direction substantially perpendicular to the vertical thus defined. Similarly, the terms "bottom" and "lower" indicate a direction directed toward the ground, while the terms "top" and "upper" indicate a direction in the opposite direction.

The frame 10 comprises an essentially tubular structure which, seen from above as in FIG. 2, has a generally hexagonal shape, with six individual rectilinear uprights 12, which extend in one and the same plane. These uprights rest on the ground by means of feet 14, distributed around the periphery of the frame. At their free end, each of these feet 14 is advantageously furnished with an adjustment screw 15 (FIG. 1), making it possible to adapt the frame 10 to any unevennesses of the ground S, so that the uprights 12 extend horizontally as much as possible. Two of the uprights 12, opposite to one another, are rigidly connected to a horizontal crossmember 16 along which a power unit 18 is arranged. This unit 18 comprises, on the one hand, an electric motor 20 whose outer case 22 is fixedly attached to the crossmember 16 and, on the other hand, a reducing-gear stage 24, mounted at the output of the motor 20 and whose output shaft 26 extends vertically, in the central zone of the hexagonal shape of the uprights 12. Under the control of the unit 18, the shaft 26 is designed to rotate on itself about its axis Z-Z, as indicated by the arrow R. The apparatus 1 comprises means, not shown, of electrical power supply and of variable control of the motor 20.

At its upper free end, the shaft 26 is secured to a rectilinear horizontal bar 30. The upper end of the shaft 26 is for example sleeve-fitted or screwed into a matching orifice of the bar 30, so that the shaft and the bar are kinematically connected to one another. In other words, when the shaft 26 rotates about its axis Z-Z, the bar 30 also rotates about this axis, in a rotary movement R.

The bar 30 extends on either side of the shaft 26. At one of its longitudinal ends, the bar 30 supports an electric motor 32 whose outer case 34 is attached to the bar 30 and whose output shaft 36 acts on a carriage 38 mounted so as to slide along the bar 30. The motor 32 is supplied from the motor 20, by means of a slip-ring 28 arranged about the shaft 26 and making it possible to make electric connections between fixed contacts of the power unit 18 and rotary contacts associated with the motor 32. Electric current may therefore travel, via this slip-ring, from the motor 20 to the motor 32, including when the bar 30 rotates about the axis Z-Z.

The apparatus 1 also comprises means, not shown, for the variable control of the motor 32.

Figure 3:
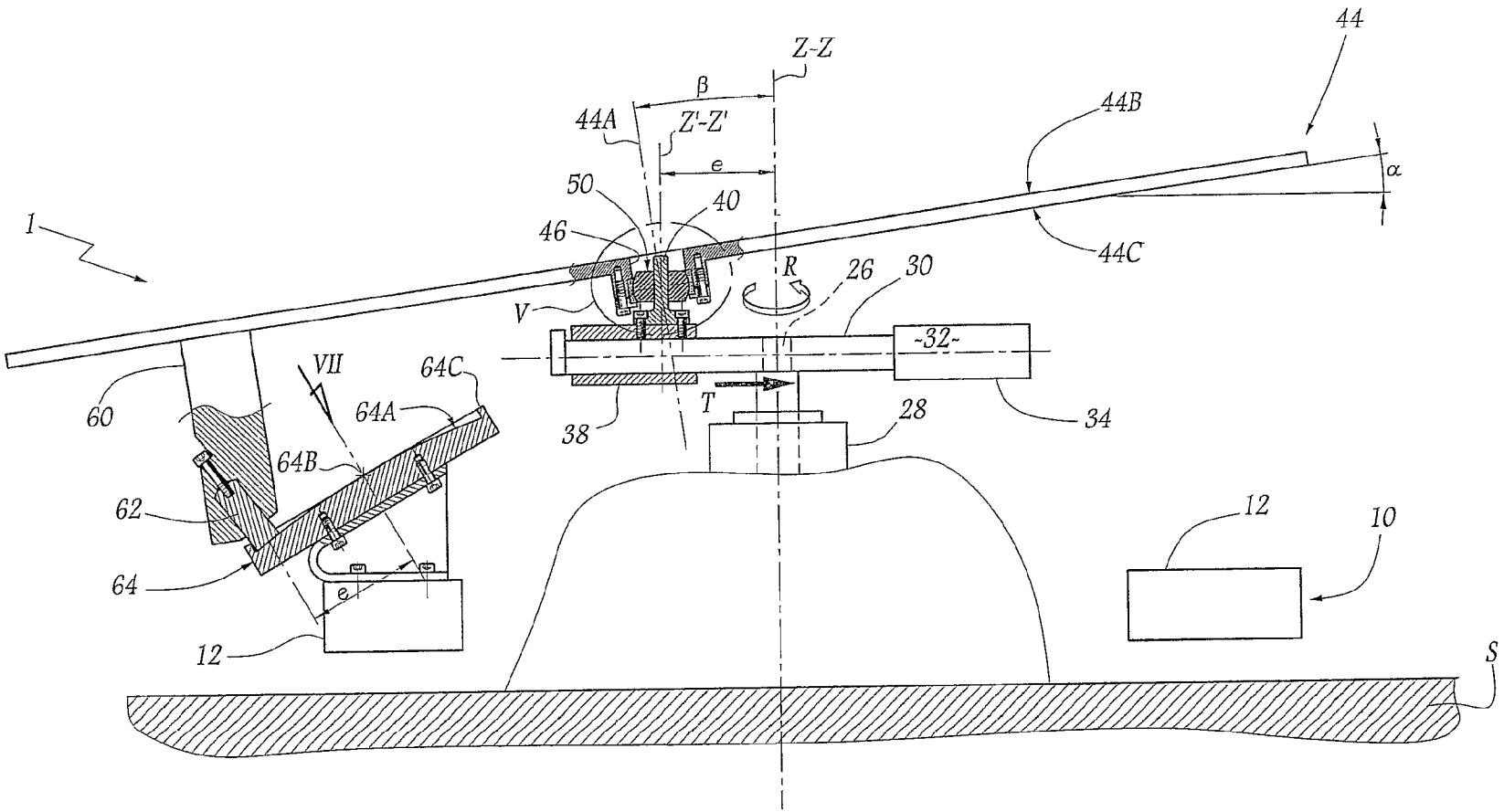
FIG. 3 is a schematic section along the line III-III of FIG. 2, with the platform of the apparatus.
Figure 4:
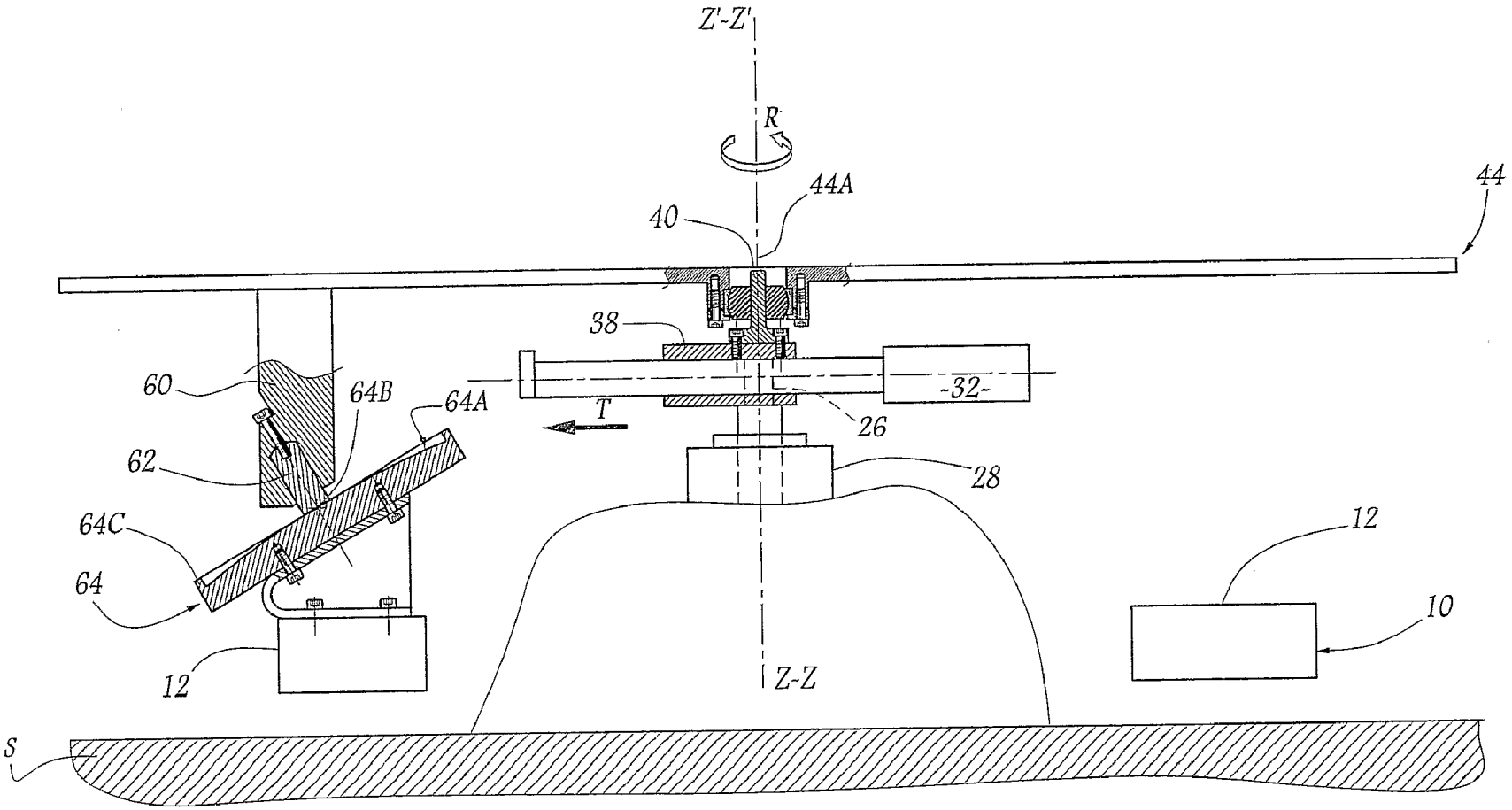
FIG. 4 is a view similar to FIG. 3, according to another operating configuration of the apparatus.

The carriage 38, under the control of the output shaft 36 of the motor 32, can be moved in a horizontal translational movement T, along the bar 30 which thereby forms a slide, between two extreme positions respectively represented in FIGS. 3 and 4. End-of-travel detectors are advantageously provided along the bar 30 and connected to the means of control of the motor 32.

The carriage 38 supports a vertical rectilinear rod 40 whose bottom portion is secured fixedly to the carriage. The axis Z'-Z' of this rod 40 therefore extends parallel to the axis Z-Z of the shaft 26, while being able to be moved relative to this axis Z-Z in the horizontal translational movement T. In its extreme position of FIG. 3, the carriage 38 positions the axis Z'-Z' at a distance from the axis Z-Z, with a horizontal off-center distance marked e in FIG. 3. In its extreme position of FIG. 4, the carriage 38 is placed in line with the shaft 26, so that the axes Z-Z and Z'-Z' extend vertically in the extension of one another. Between these two extreme positions, the offcentering of the axis Z'-Z' relative to the axis Z-Z is variable, depending on the position of the carriage 38 along the slide bar 30, under the control of the motor 32, between a maximum value corresponding to the aforementioned distance e for the carriage position of FIG. 3 and a zero value for the carriage position of FIG. 4.

In service, when the shaft 26 rotates on itself about its axis Z-Z, the rod 40 is therefore rotated about this axis Z-Z, while being either thrown offcenter relative to this axis when the offcentering of the axis Z'-Z' is not zero, or in the vertical extension of the shaft 26 when this offcentering is zero. In the latter case, the rod 40 then rotates on itself, about its axis Z'-Z' indistinguishable from the axis Z-Z.

The mobilization apparatus 1 also comprises a platform 44, being generally disk-shaped, defining a central axis of revolution 44A, and a substantially flat upper face 44B and lower face 44C.

In its central portion, the platform 44 delimits an orifice 46 that is centered on the axis 44A and whose emergence on the lower face 44C is surrounded by an annular flange 48 made of the same material as the rest of the platform 44.

Figure 5:
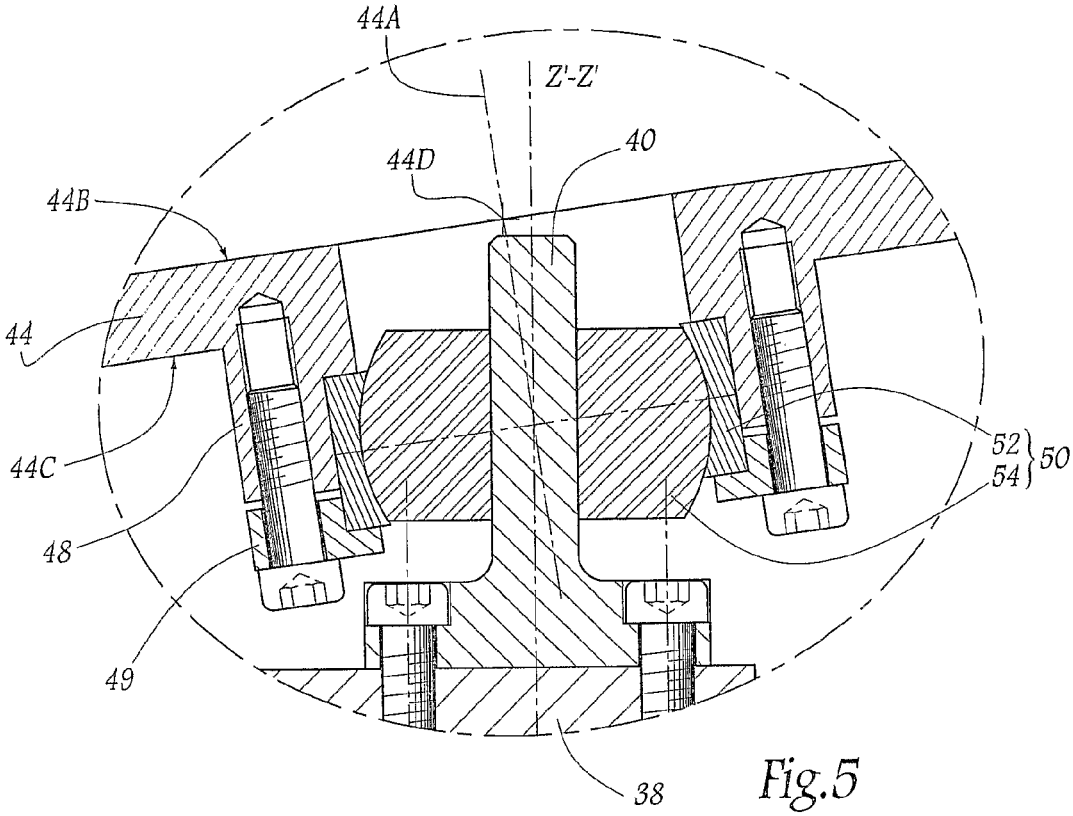
FIG. 5 is a view on a larger scale of the detail V in FIG. 3.

The platform 44 is suitable for being assembled to the carriage 38, by inserting the rod 40 from the bottom into the orifice 46, with interposition of a swivel joint 50 represented in greater detail in FIG. 5. This swivel joint 50 comprises, on the one hand, an outer socket 52, immobilized in the flange 48 by a bolted cover 49, and, on the other hand, an inner ball 54 delimiting an inner bore with a cross section that matches that of the rod 40. In a manner known per se, the outer socket and the inner ball articulate in one another, by interaction of respective hemispherical surfaces allowing the inner ball to pivot freely in all directions relative to the outer socket, with predetermined maximum clearances. In this way, when the platform 44 is fitted around the rod 40, this platform may pivot freely about the inner ball 54 of the swivel joint 50.

Figure 6:
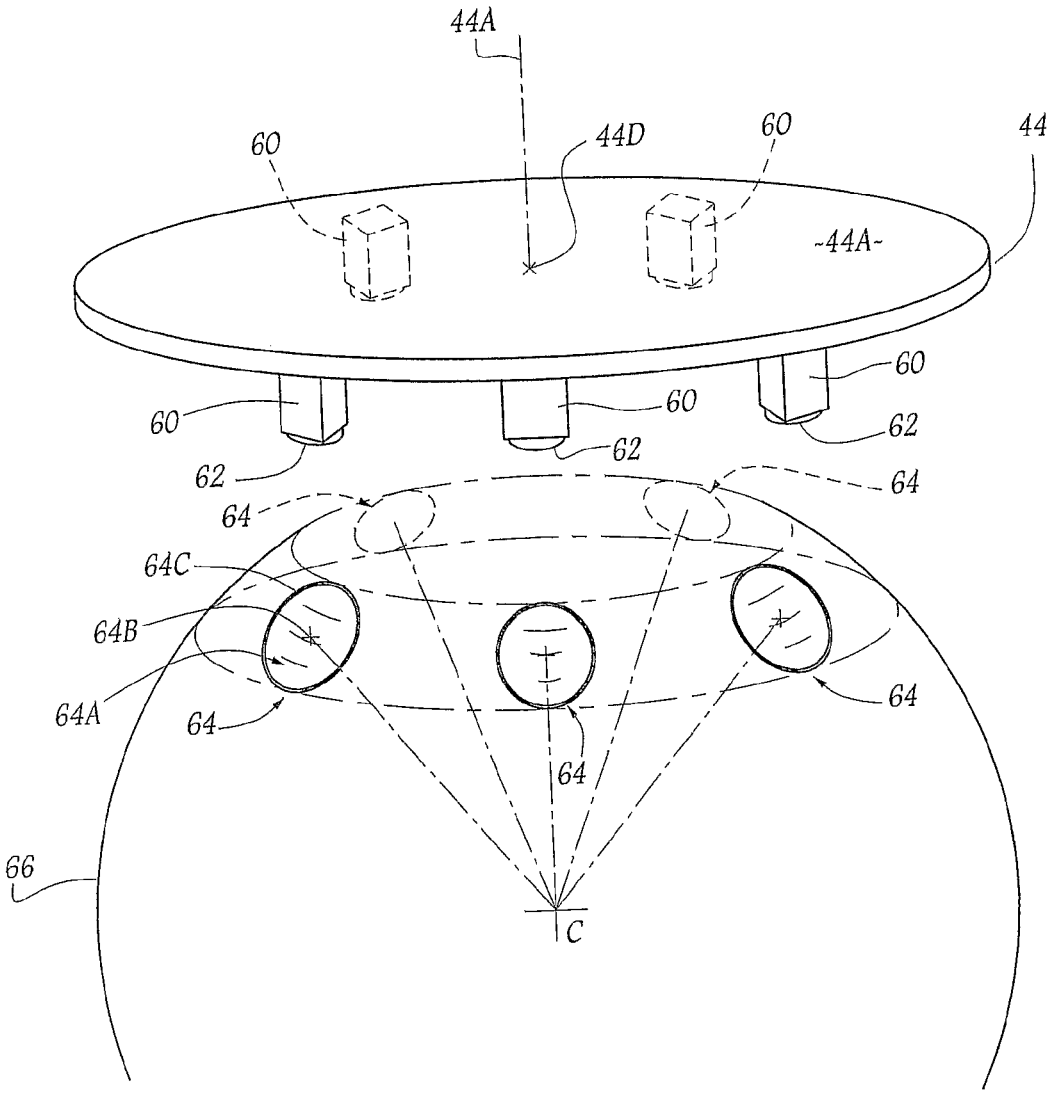
FIG. 6 is a diagram in perspective of the platform of the apparatus, associated with an imaginary geometric shape making it possible to understand the kinematics of operation of the platform.

In its outer periphery, the platform 44 is furnished, in a fixed manner, with five feet 60 extending downward in protrusion from its lower face 44C as shown schematically in FIG. 6. The feet 60 are designed to rest on the frame 10 when the platform is fitted around the rod 40, so that the weight of the platform is, at least mostly, and even exclusively, supported by the frame via the feet 60, while the lower face of the swivel joint 50 is pressed against none of the elements situated beneath the central zone of the platform, notably the carriage 38.

Each foot 60 extends, generally in a direction parallel to the axis 44A and comprises, at its lower end, a sliding shoe 62 fixedly attached to the foot, for example by sleeve-fitting and/or by screwing. Each shoe 62 is suitable for resting against a discal element 64 fixedly attached to the frame 10. As shown in FIG. 2, five discal elements 64 are provided, respectively at five of the six uprights 12 of the frame, while being distributed in a substantially uniform manner along the periphery of these uprights.

Each discal element 64 has a convex upper surface 64A against which the shoe 62 rests in a sliding manner, a lubricant advantageously being able to be applied to the surface 64A. This surface 64A corresponds to a portion of an imaginary sphere 66 represented schematically in FIG. 6. This sphere 66, common to all the surfaces 64A of the discal elements 64, defines a center C through which the axis Z-Z passes, while each portion of surface 64A extends about a central axis corresponding to a diameter of the sphere 66 and has an outer circular contour centered on this axis, as shown in FIG. 7.

When the platform 44 is fitted around the rod 40, the shoes 62 rest in mobile contact against the surfaces 64A of the discal elements 64, as shown in FIGS. 3 and 4 and as indicated schematically in an exploded manner in FIG. 6. When each of the shoes 62 is positioned substantially in the center 64B of the corresponding surface 64A, as shown in FIG. 4, and as indicated schematically in dashed lines in FIG. 7, the platform 44 extends horizontally, being centered on the axis Z-Z, as shown schematically in FIG. 6. The assembly of the platform 44 around the rod 40 can therefore be envisaged only if this rod extends coaxially to the axis Z-Z with the carriage 38 in its position of FIG. 4.

By sliding against the surfaces 64A, the shoes 62 can be freely moved in a centered manner on the center C of the imaginary sphere 66. The clearances of each shoe are limited by the transverse extent of the surface 64A, surrounded by a protruding border 64C.

Figure 7:
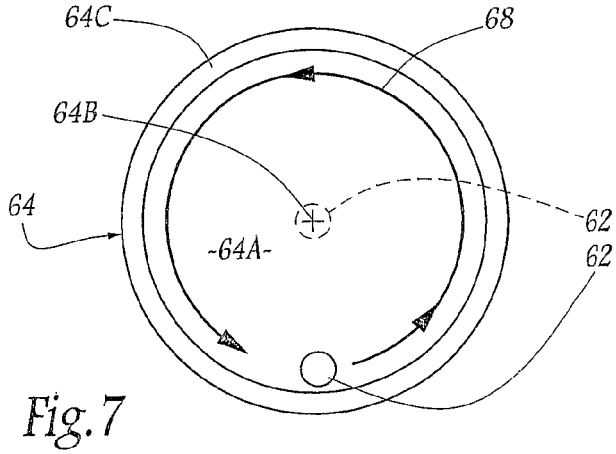
FIG. 7 is a schematic view in elevation of a portion of the apparatus in the direction of the arrow VII indicated in FIG. 3.

It is understood that the platform 44 can be moved in one piece relative to the discal elements 64, so that, when one of the shoes 62 occupies an extreme bottom position with respect to its associated surface 64A, as shown in FIG. 3 and as indicated schematically as a solid line in FIG. 7, the other shoes 62 occupy, against their associated surface 64A, intermediate positions between this extreme bottom position and an extreme top position diametrically opposed to the extreme bottom position relative to the center 64B of the surface 64A. The platform 44 is then tilted relative to a horizontal plane, that is to say that its axis 44A forms a nonzero angle β with the vertical while its central orifice 46 is radially thrown off center relative to the axis Z-Z. When the platform 44 is assembled around the rod 40, such a tilt of the platform is therefore allowed only when the rod 40 is thrown offcenter relative to the axis Z-Z, as in FIG. 3. In practise, the radial distance between the center 64B of the surface 64A and the shoe 62 in the extreme bottom position corresponds substantially to the aforementioned value e.

Therefore, when the platform 44 is assembled around the rod 40, it is understood that the operation of the carriage 38 in the direction of horizontal translation T causes the platform 44 to travel between its horizontal configuration of FIG. 4 and its tilted configuration of FIG. 3, by sliding pressure of the shoes 62 against the surfaces 64A of the elements 64, the tilt of the platform relative to the rod 40 being allowed by the swivel joint 50.

An example of use of the apparatus 1 will be described below.

Figure 1:
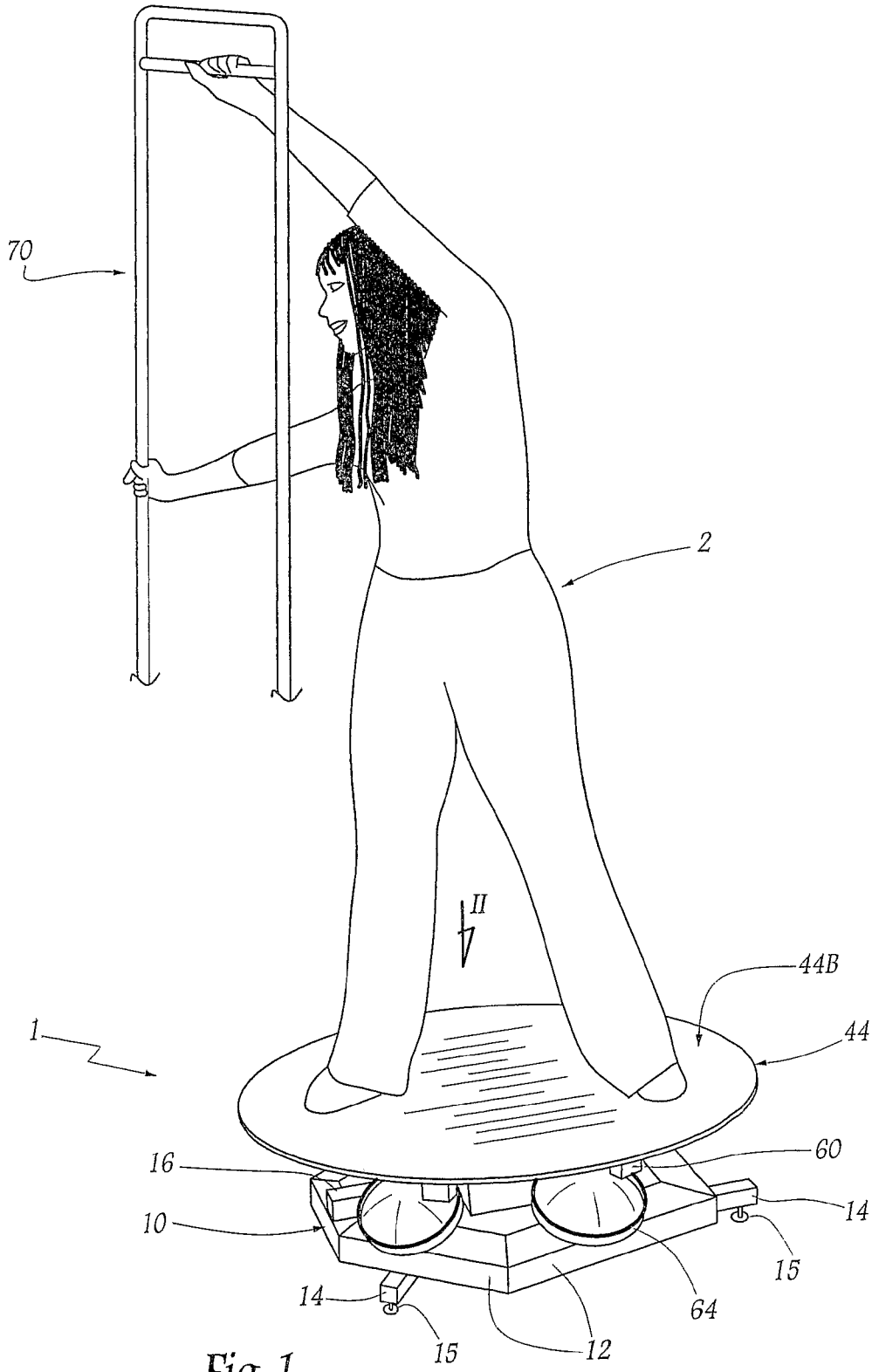
FIG. 1 is a schematic view in perspective of an apparatus according to the invention, on which a subject is being mobilized.

Initially, it is considered that the platform 44 occupies its horizontal configuration of FIG. 4. The subject 2 therefore easily mounts the platform 44 with his feet resting on the upper surface 44B of this platform, as shown in FIG. 1. In this configuration, if the motor 20 is actuated, the shaft 26 rotates on itself about its axis Z-Z and, by means of the bar 30, this rotary movement is communicated to the rod 40, which also rotates on itself. The ball 54 then rotates freely inside the socket 52 and the platform 44 remains immobile relative to the frame 10.

Now considering that the motor 20 is stopped and that the motor 32 is actuated, the carriage 38 is moved horizontally according to the movement T. The platform 44 is then operated in a corresponding translational movement. Since this platform rests via these shoes 62 on the surfaces 64A of the discal elements 64, this translational movement causes the platform to tilt so that the latter forms a non-zero angle $\alpha$ with the horizontal in the plane of FIG. 3, that is to say in the vertical plane P passing through both the axes Z-Z and Z'-Z'. At the maximum, this tilt may be adjusted until one of the shoes 62 butts against the peripheral border 64C of its associated discal element 64, as in FIG. 3. In this tilted configuration, the subsequent actuation of the motor 20, while the motor 32 is stopped, causes the axis Z'-Z' to rotate offcenter about the axis Z-Z, so that the plane P containing the axes Z-Z and Z'-Z' rotates about the axis Z-Z in the rotary movement R. This means that the axis 44A of the platform 44 also rotates about the axis Z-Z, according to the rotation R, so that, at the end of one revolution in itself of the shaft 26, this axis 44A generates a substantially conical casing surface, with an axis Z-Z and a half-angle at the vertex $\beta$ which corresponds to the tilt $\alpha$ of the platform 44 in the plane P. Seen from above, in the vertical direction, the center 44D of the platform, defined by the intersection between the axis 44A and the face 44B, describes a circular trajectory T$\mathbf{44}_1$ centered on the axis Z-Z and having a radius of substantially e, as shown in FIG. 8. At the same time, the shoes 62 slide against the surface 64A of their corresponding discal element 64 in a substantially circular trajectory centered on the center 64B of this surface, as shown at 68 in FIG. 7.

When the tilt is not adjusted to its maximum, which amounts to saying that the carriage 38 is offcenter with a nonzero value of less than e, the center 44D of the platform 44 describes a circular trajectory centered on the axis Z-Z and with a radius of less than e. Two examples of such intermediate trajectories, referenced T$\mathbf{44}_2$ and T$\mathbf{44}_3$ are represented in FIG. 8.

If, during the rotation R controlled by the motor 20, the offcenter distance between the axes Z-Z and Z'-Z' is modified, by moving the carriage 38 along the sliding bar 30, the movement of the platform 44 departs from the basic kinematics described above in order to adopt a more elaborate kinematic, which however is instantaneously similar to the basic kinematic. For example, if the rotary movement R is maintained with a constant intensity and if it is combined with the translational movement T, the center 44D of the platform describes, seen from above, a trajectory T$\mathbf{44}_4$ in the shape of a spiral centered on the axis Z-Z, as shown in FIG. 9.

It can therefore be understood that, when the offcenter distance between the axes Z-Z and Z'-Z' is not zero, as in FIG. 3, the rotary motive movement R operates the platform 44 so that it describes an offcenter rotary travel about the axis Z-Z, while being tilted relative to a horizontal plane, the tilt $\alpha$ of the platform being the most marked in the plane P containing the axes Z-Z and Z'-Z'. The subject standing on the platform 44 is then thrown off balance and is subjected to a centrifugal force: the bodily axis of the subject corresponds generally to the axis 44A, so that the vertical projection of the center of gravity of the subject is instantaneously thrown offcenter relative to the axis Z-Z, while being at a distance from the center of the basis of support of the subject's body, while this basis of support is made to move by the platform. Depending on the adjustment of the tilt $\alpha$ of the platform, the imbalance of the subject is more or less accentuated, forcing the latter to mobilize his body in a corresponding manner in order not to fall. In practise, the apparatus 1 is associated with a fixed handrail 70, for example secured to the frame 10, which the subject can grasp to prevent a total loss of balance. This handrail 70 is schematically represented in FIG. 1 only, it being understood that various forms of means allowing the subject to stand on the platform in movement can be envisaged.

The apparatus 1 is controlled by a physiotherapist or, more generally, a health professional, who adjusts the operating speed of the motor 20, the tilt $\alpha$ of the platform 44 by adjusting the position of the carriage 38 along the sliding bar 30 by controlling the motor 32 and the possible actuation of the motor 32 while the motor 20 runs, which amounts to combining the rotary movement R and the horizontal translational movement T. If the apparatus 1 is intended to be used in an autonomous manner by the subject, the control means are advantageously incorporated into the handrail 70, so that the subject can modify the operating kinematics of the platform 44 during his exercise. On this subject, for the use of the apparatus 1 in a gym, it will be noted that, in operation, all the muscles of the subject's body are rapidly and intensely worked, which combines a significant burning-off of fat and exercises of articular flexing and of coordinated musculation.

In all cases, control programs for the motors 20 and 32 may be predetermined, being stored notably in a memory that can be accessed by the aforementioned control means.

FIGS. 10 and 11 relate to a variant embodiment of the apparatus 1. This variant differs from the apparatus considered in FIGS. 1 to 9 only by its bearing elements, of the platform 44, which replace the elements 64 envisaged hitherto. More precisely, the elements 64 are replaced by five elements $\mathbf{84}_1$ to $\mathbf{84}_5$, distributed along the periphery of the frame 10 in the same manner as the elements 64. The element $\mathbf{84}_3$ is identical to the corresponding element 64, while the other elements $\mathbf{84}_1$, $\mathbf{84}_2$, $\mathbf{84}_4$ and $\mathbf{84}_5$ each correspond to an element 64, but with a larger transverse size: the two elements $\mathbf{84}_2$ and $\mathbf{84}_4$ closest to the element $\mathbf{84}_3$ therefore have a radial dimension, relative to their central axis, approximately one and a half times greater than the corresponding dimension of the elements 64, while the two elements $\mathbf{84}_1$ and $\mathbf{84}_5$ furthest from the element $\mathbf{84}_3$ have a radial dimension approximately twice as large as the corresponding dimension of the elements 64.

Apart from this, radial dimension, the structural features of the elements $\mathbf{84}_1$ to $\mathbf{84}_5$ are similar to those of the elements 64: each of the elements $\mathbf{84}_1$ to $\mathbf{84}_5$ has a convex upper surface

84$A_1$ to 84$A_5$ which corresponds to a portion of the imaginary sphere 66 of FIG. 6 and which is surrounded by a protruding peripheral border 84$C_1$ to 84$C_5$.

The variant embodiment of FIGS. 10 and 11 furthermore comprises, an additional component, namely a guide plate 90 fixedly attached, by securing means not shown, to any one of the elements 84$_1$ to 84$_5$, to the element 84$_3$ in the example shown, while covering its surface 84$A_3$ in the manner of a cap. This plate therefore has a generally discal shape, designed to be received in a matching manner inside the border 84$C_3$ with its lower surface 90A matching the surface 84$A_3$, as shown in FIG. 11. The plate 90 delimits, along one of its diameters, a groove 92 passing through the plate from side to side along its thickness and therefore emerging on the surface 84$A_3$ when the plate is assembled to the element 84$_3$. In the assembled state of FIG. 10, the longitudinal direction of this groove belongs to the vertical plane P84$_3$ containing the axis Z-Z and the center 84$B_3$ of the element 84$_3$, it being noted that this plane corresponds to the plane of FIG. 11. The groove 92 is suitable for receiving the shoe 62 of the foot 60 associated with the element 84$_3$, the width of the groove being substantially equal to the corresponding dimension of the shoe. The vibrations or small ranges of movement of the platform 44 relative to the frame 10 are thereby limited, conferring on the platform a greater stability for the subject standing on this platform. In addition, when the shoe 62 is received in the groove 92, this shoe can be moved, relative to the element 84$_3$, only along the groove 92, in other words along the rectilinear trajectory 94 contained in the plane P84$_3$ of FIG. 11. In these conditions, the groove 92 prevents the corresponding shoe 62 from describing a circular trajectory against the surface 84$A_3$, similar to the trajectory 68 of FIG. 7, which disrupts the movement of the whole platform 44.

In operation, when the platform 44 is rotated offcenter about the axis Z-Z, it moves away from the position that it would occupy in the absence of the plate 90, while accommodating its inability to travel from side to side of the plane P84$_3$ at the element 84$_3$, by greater movements at the other elements, in particular at the elements 84$_1$ and 84$_5$ furthest from the element 84$_3$. When the offcenter movement of the platform is maximal (value e), the center 44D of the platform describes the trajectory T44$_5$ represented in FIG. 12, that is to say a trajectory centered about the axis Z-Z and having an ampler curved shape on the side of the elements 84$_1$ and 84$_5$. At the peripheral portions of the platform in line with the elements 84$_1$ and 84$_5$, the amplitude of the movements of the platform is of the order of twice that at the peripheral portion of the platform in line with the element 84$_3$, which explains the design of the elements 84$_1$ to 84$_5$. FIG. 12 also represents intermediate trajectories T44$_6$ and T44$_7$, similar to the trajectories T44$_2$ and T44$_3$ shown in FIG. 8, that is to say for offcenter values smaller than the value e. Similarly, FIG. 13 shows a trajectory T44$_8$ obtained in the same operating conditions as for the trajectory T44$_4$ of FIG. 9, that is to say by combining the offcenter rotary movement R and the horizontal translational movement T.

Thanks to this variant embodiment, the apparatus 1 supplies bodily mobilization kinematics that are more intricate than those supplied by the apparatus of FIGS. 1 to 9, inducing differentiated biomechanical reactions for the subject depending on whether the latter is standing, amongst other things, in the central zone of the platform, in the peripheral zone overhanging the element 84$_3$ or in the opposite peripheral zone overhanging the elements 84$_1$ and 84$_5$.

Advantageously, the angular position of the plate 90 can be adjusted relative to the discal element 84$_3$ so that the position of the groove 92 may be modified so as to have the direction of the trajectory 94 vary relative to the plane P84$_3$. In the configuration of the groove 92 represented in dashed lines in FIG. 10, the trajectory 94 forms an angle of approximately 45° with the plane P84$_3$, seen from above in the vertical direction. Depending on the operating adjustments of the apparatus 1, the center 44D of the platform 44 describes trajectories T44$_9$ to T44$_{12}$ represented in FIGS. 14 and 15 corresponding respectively to the trajectories T44$_5$ to T44$_8$ of FIGS. 12 and 13.

By changing the direction of the trajectory 94 relative to the axis Z-Z, the user induces a dissymmetry of the ranges of movements of the platform 44 relative to the plane P84$_3$ which makes it possible to exercise in a manner differentiated in intensity the opposite sides of the subject standing on the platform.

Optionally, the apparatus incorporates means not shown making it possible to have the direction of the trajectory 94 vary relative to the fixed axis Z-Z during the operation of the apparatus 1, by rotation of the plate 90 against the surface 84$A_3$.

FIGS. 16 to 18 represent schematically another embodiment of an overall bodily mobilization apparatus 100. As for the apparatus 1 of the preceding figures, the apparatus 100 essentially comprises a fixed frame 110, a movable platform 112 and means for operating the platform relative to the frame, these operating means being in the form of two motorized cylinders 114 and 116, both connected to one and the same control and adjustment unit 118.

The platform 112 defines a central axis of revolution 112A and delimits, on the one hand, an upper face 112B on which the subject is intended to stand and, on the other hand, a lower face 112C directed toward the frame 110. The platform 112 is surrounded, on its outer periphery, by an edge 120 extending downward from the face 112C and furnished, at its lower end, with an inner ring 122 suitable for resting on the frame 110. Accordingly, the frame 110 includes, in its upper portion, a hemispherical wall 124 extending all around a rigid central post 126 whose longitudinal axis W-W is substantially vertical. The lower surface 122A of the ring 122 substantially matches the upper surface 124A of the wall of the frame 124 so that the platform 112 has capabilities of movement relative to the frame 110 similar to those of the platform 44 relative to the frame 10 for the apparatus 1 of FIGS. 1 to 7, the hemispherical surface 124A matching a dome of the imaginary sphere 66 considered in FIG. 6.

Each cylinder 114, 116 comprises a rod 130, 132 that can be moved in translation in its longitudinal direction relative to the body 134, 136 of the cylinder. The free end of each rod 130, 132 rests against the central post 126 of the frame 110 so that the deployment or retraction of the rod relative to its body 134, 136 cause this body to move further away or respectively closer to the post 126. The end of each body 134, 136 opposite to the corresponding rod 130, 132 is mechanically connected to the edge 120 of the platform 112, with interposition of a swivel joint 138, 140.

Seen from above, as in FIG. 16, the cylinders 114 and 116 extend lengthwise in a manner transverse to the axis W-W defined by the central post 126, forming between them an angle of approximately 90°.

The unit 118 is suitable for controlling the deployment and the retraction of each rod 130, 132 relative to the corresponding body 134, 136 of the cylinders, which causes the platform 112 to move relative to the frame 110, the movement of the cylinder body being transmitted to the platform by means of the swivel joint 138, 140.

At rest, as shown in FIGS. 16 and 17, the total lengths of the cylinders 114 and 116 are designed so that the platform 112 extends in a substantially horizontal manner, its axis 112A then being substantially indistinguishable from the axis W-W. In service, when the unit 118 controls, for example, the deployment of the rod 130, the cylinder body 134 is translated radially and outward relative to the axis W-W as indicated by the arrow T in FIG. 18. The platform 112 is then operated in a corresponding translational movement, combined with a tilting relative to the horizontal in the plane of FIG. 17, by the sliding of the surface 122A against the surface 124A. The axes W-W and 112A then form a nonzero angle β. It is understood that a similar control of the cylinder 116 by the unit 118 causes an offcentering and a tilting similar to the platform 112 relative to the frame 110, so that, by means of an appropriate control loop, notably by electronic means, the coordinated control of the two cylinders 114 and 116 makes it possible to operate the platform 112 in a kinematic similar to that described above for the platform 44 relative to the frame 10, that is to say which makes it possible at the same time, by the translation T, to throw the platform offcenter relative to the axis W-W and to rotate it, as indicated by the arrow R, about this axis when it is offcenter, with the platform then tilted relative to the horizontal in the vertical plane passing through the axes W-W and 112A.

Naturally, the embodiment of FIGS. 16 to 18 may incorporate the teaching of the variant of FIGS. 10 to 15, in the sense that the ring 122 may, at a point on its periphery, be guided relative to the frame wall 124 in a rectilinear trajectory like the trajectory 94. To do this, a rectilinear guide rail is, for example, fitted to the upper surface 124A of the wall 124, while a foot, similar to one of the feet 60 and attached to the lower surface 122A of the ring 122, is received in a sliding manner in this rail. As an option, the position of the rail relative to the wall 124 may be changed to adjust the orientation of the trajectory 94 relative to a fixed vertical plane, which makes it possible to describe at the center of the platform 112 trajectories like the trajectories $T44_5$ to $T44_{12}$ of FIGS. 12 to 15.

Various optional arrangements and variants to the items of mobilization apparatus 1 and 100 described above can furthermore be envisaged. As examples:

- to damp the abutting of the shoes 62 against the border 64C of their corresponding discal element 64 when, the platform 44 is tilted with its maximal amplitude, each shoe 62 may be furnished with a flexible peripheral padding, for example in the form of a ring fitted around the main body of the shoe;
- other embodiments of the end of the feet 60 pressing movably on the discal elements 64 are possible, the shoes 62 being able for example to be replaced by balls or other rolling elements; in particular, the shoes 62 may be replaced by rollers, notably connected in a freewheeling manner to the lower face of the platform; such rollers have the advantage of adapting instantaneously to the movements of the platform without inertial or braking effect;
- in the absence of the plate 90, to prevent vibrations or small movements of the platform 44 relative to the discal elements, linked notably to the clearances inherent in the apparatus, dampers, of the pneumatic cylinder type for example, may be provided directly interposed between each foot 60 and the frame 10;
- if the user foregoes the ability to vary the degree of offcentering between the axes Z-Z and Z'-Z' during the rotary movement R generated by the power unit 18, the motor 32 may be replaced by any mechanical means making it possible to adjust the position of the carriage 38 along the bar 30, such a means notably being controlled manually, preferably before the subject gets onto the platform 44;
- the platforms 44 and 112 may have other shapes than the generally discal shape envisaged above; these platforms may therefore have, when seen from above, an ovoid, rectangular, etc. shape;
- rather than providing for the carriage 38 to be placed in abutment along the sliding bar 30 when it is in line with the shaft 26, the sliding bar may be designed lengthwise so that the carriage may be moved translationally either side of the axis Z-Z;
- the number of foot 60/discal element 64 pairs may be provided to be higher or lower than five; similarly, rather than providing distinct elements distributed along the outer periphery of the apparatus, the bearing means of the platform on the frame and/or the corresponding supporting means may take shapes of production extending continuously over the periphery of the apparatus, like the ring 122; for example, the discal elements 64 may therefore be replaced by an annular wall centered on the axis Z-Z and corresponding to the portion of the sphere 66 delimited in dashed lines in FIG. 6;
- the apparatus may incorporate an opto-kinetic mechanism, supplying a point of light that the subject must aim at by looking at it; and/or
- above the apparatus, a suspension of the bar or ball type may be provided to carry out proprioceptive and muscular exercises.

The invention claimed is:

1. An apparatus for overall bodily mobilization of a human subject, comprising:

a frame for resting fixed on the ground, a platform for supporting the human subject, wherein the platform moves relative to the frame both in rotation about a substantially vertical fixed axis and according to an off-center mobility, motorized operating means for operating the platform relative to the frame, wherein the motorized operating means throw the platform off-center relative to the substantially vertical fixed axis and rotate the platform about the substantially vertical fixed axis when the platform is off-center, peripheral bearing means for bearing the weight of the human subject on corresponding supporting means for supporting the peripheral bearing means, the supporting means being secured to the frame and the peripheral bearing means being secured to an outer periphery of the platform, wherein the peripheral bearing means and the supporting means enable the platform to rest on the frame in a movable manner when the motorized operating means throw the platform off-center relative to the substantially vertical fixed axis and rotate the platform about the substantially vertical fixed axis, while tilting the platform in an adjustable manner relative to a horizontal direction in a plane passing through the substantially vertical fixed axis and a central zone of the platform, wherein the peripheral bearing means comprise a plurality of bearing elements that are distinct from one another and are distributed in a substantially uniform manner along the periphery of the platform, respectively, for resting locally on the supporting means.

2. The apparatus as claimed in claim 1, wherein the peripheral bearing means and the supporting means enable the platform to rest on the frame in a substantially horizontal manner when the platform is substantially centered on the substantially vertical fixed axis.

3. The apparatus as claimed in claim 1, wherein the supporting means define a substantially spherical casing surface centered on the substantially vertical fixed axis, wherein at least a portion of the spherical casing surface is born by the peripheral bearing means in a movable manner.

4. The apparatus as claimed in claim 3, wherein the supporting means comprise a plurality of supporting elements that are distinct from one another and are distributed in a substantially uniform manner in a peripheral direction of the frame, each of the supporting elements defining a portion of the spherical casing surface.

5. The apparatus as claimed in claim 1, further comprising guidance means for guiding the peripheral bearing means relative to the supporting means, the guidance means imposing on the bearing means a substantially rectilinear trajectory only at a peripheral portion of the platform.

6. The apparatus as claimed in claim 5, wherein:

the guidance means comprise a groove for receiving one of the bearing elements, the groove guiding the element on the substantially rectilinear trajectory.

7. The apparatus as claimed in claim 5, wherein the guidance means are adjustable and vary the direction of the substantially rectilinear trajectory relative to the substantially vertical fixed axis.

8. The apparatus as claimed in claim 1, wherein the platform comprises articulated connection means for connecting in an articulated manner with the motorized operating means, wherein the articulated connection means are operated in an off-center manner about the substantially vertical fixed axis.

9. The apparatus as claimed in claim 8, wherein the articulated connection means are arranged at the central zone of the platform.

10. The apparatus as claimed in claim 8, wherein the articulated connection means comprise at least one swivel joint about which the platform is freely articulated.

11. The apparatus as claimed in claim 1, wherein the motorized operating means comprise a rotary shaft whose longitudinal axis constitutes the substantially vertical fixed axis.

12. The apparatus as claimed in claim 11, wherein the motorized operating means further comprise a slide for throwing the platform off-center relative to the substantially vertical fixed axis, the slide extending transversely to the rotary shaft while being kinematically connected to the rotary shaft.

13. The apparatus as claimed in claim 12, wherein the platform comprises articulated connection means for connecting in an articulated manner with the motorized operating means, wherein the articulated connection means are operated in an off-center manner about the substantially vertical fixed axis and the articulated connection means are supported by a carriage mounted in translation along the slide and controlled in movement by an actuator supported by the slide.

14. The apparatus as claimed in claim 11, wherein the motorized operating means comprise:

a first electric motor comprising a case fixed relative to the frame and an output shaft kinematically connected to the rotary shaft;

a second electric motor comprising a case kinematically connected to the rotary shaft, wherein the second electric motor controls throwing the platform off-center;

a slip-ring that enables an electric current to pass from the first electric motor to the second electric motor.

15. The apparatus as claimed in claim 1, wherein both an amplitude associated with throwing the platform off-center relative to the substantially vertical fixed axis and a speed of rotary operation of the platform about the substantially vertical fixed axis are adjusted in a combined or separate manner.

* * * * *